US010988862B2

(12) United States Patent
Akiyama et al.

(10) Patent No.: US 10,988,862 B2
(45) Date of Patent: Apr. 27, 2021

(54) METHOD FOR MANUFACTURING CARBON FIBERS AND FIBER JOINING METHOD

(71) Applicant: TOHO TENAX CO., LTD., Tokyo (JP)

(72) Inventors: Fumio Akiyama, Tokyo (JP); Tadayuki Aoyama, Tokyo (JP); Ichiro Kitano, Tokyo (JP)

(73) Assignee: TOHO TENAX CO., LTD., Tokyo (JP)

( * ) Notice: Subject to any disclaimer, the term of this patent is extended or adjusted under 35 U.S.C. 154(b) by 185 days.

(21) Appl. No.: 16/074,685

(22) PCT Filed: Jan. 31, 2017

(86) PCT No.: PCT/JP2017/003477

§ 371 (c)(1),
(2) Date: Aug. 1, 2018

(87) PCT Pub. No.: WO2017/135265

PCT Pub. Date: Aug. 10, 2017

(65) Prior Publication Data

US 2019/0040551 A1 Feb. 7, 2019

(30) Foreign Application Priority Data

Feb. 3, 2016 (JP) ..... JP2016-018820

(51) Int. Cl.

| | |
|---|---|
| ***D01F 9/21*** | (2006.01) |
| ***D02J 1/08*** | (2006.01) |
| ***D01F 9/22*** | (2006.01) |
| ***D01F 9/32*** | (2006.01) |
| ***B65H 69/06*** | (2006.01) |
| *D01D 10/02* | (2006.01) |

(52) U.S. Cl.

CPC ..... *D01F 9/21* (2013.01); *B65H 69/061* (2013.01); *D01F 9/22* (2013.01); *D01F 9/225* (2013.01);

(Continued)

(58) Field of Classification Search

CPC ... D01F 9/21; D01F 9/22; D01F 9/225; B65H 69/061

See application file for complete search history.

(56) References Cited

U.S. PATENT DOCUMENTS

2011/0217228 A1* 9/2011 Mishima ..... D02J 1/08 423/447.1
2015/0233024 A1 8/2015 Mishima et al.

FOREIGN PATENT DOCUMENTS

EP 2 348 143 A1 7/2011
JP H11-131348 A 5/1999

(Continued)

OTHER PUBLICATIONS

Search Report dated Aug. 5, 2019, in connection with European Patent Application No. 17747421.0.

(Continued)

*Primary Examiner* — Joseph S Del Sole
*Assistant Examiner* — Yung-Sheng M Tsui
(74) *Attorney, Agent, or Firm* — Norris McLaughlin P.A.

(57) ABSTRACT

A carbon fiber manufacturing method includes joining first and second target fiber bundles with a joining fiber bundle, and carbonizing the joined bundles by feeding them through one or more carbonization furnaces. The joining includes forming an overlap between a first end of the joining fiber bundle and a second end of the first target fiber bundle and jetting a fluid to the overlap to form a first entangled portion, and forming an overlap between a second end of the joining fiber bundle and a first end of the second target fiber bundle and jetting a fluid to the overlap to form a second entangled portion. When the first and second entangled portions each have two or more entangling points with a tensile strength not less than 400 N, the relationship defined by the inequality is satisfied: $40>\{L2/(L2-A)\}\times(S+13)$, where L2 is a length (mm) of an elongation section inside a first carbon- (Continued)

ization furnace upstream in a feeding direction of the fiber bundles, A is a maximum distance (mm) between an entangling point in the first entangled portion and an entangling point in the second entangled portion, and S is an elongation (%) of the joined fiber bundles fed through the carbonization furnace.

6 Claims, 4 Drawing Sheets

(52) U.S. Cl.
CPC ..... *D01F 9/328* (2013.01); *D02J 1/08* (2013.01); *B65H 2701/314* (2013.01); *D01D 10/02* (2013.01)

(56) References Cited

FOREIGN PATENT DOCUMENTS

| | | | |
|---|---|---|---|
| JP | 2008-174846 | A | 7/2008 |
| JP | 2010-133074 | A | 6/2010 |
| JP | 2010-255168 | A | 11/2010 |
| JP | 2015-120582 | A | 7/2015 |

OTHER PUBLICATIONS

International Search Report dated Apr. 19, 2017 dated May 9, 2017.
English translation of International Search Report dated Apr. 19, 2017 dated May 9, 2017.

* cited by examiner

METHOD FOR MANUFACTURING CARBON FIBERS AND FIBER JOINING METHOD

This application is a 371 of PCT/JP2017/003477, filed Jan. 31, 2017, which claims foreign priority benefit under 35 U.S.C. § 119 of the Japanese Patent Application No. 2016-018820 filed Feb. 3, 2016, the disclosures of which are incorporated herein by reference.

TECHNICAL FIELD

The present invention relates to a method for manufacturing carbon fibers including a joining process for joining target fiber bundles using a joining fiber bundle, and a fiber joining method.

BACKGROUND ART

Carbon fibers have high tensile strength, high tensile modulus, high heat resistance, and good fatigue characteristics, and thus have various uses in fields such as sports, leisure, aviation, and aerospace.

Carbon fibers are produced from fiber materials such as acrylic fibers. Bundled acrylic fibers are heated to 150 to 300° C. in the air to obtain oxidized fibers. The fibers are then heated to 1,000° C. or higher in an inert atmosphere in a carbonization furnace to produce carbon fibers. Such fiber materials are usually wound on bobbins or stored in packages such as bags or cases. When a bobbin or a package with a fiber bundle is to be replaced during continuous manufacture of carbon fibers, the terminal end of the fiber bundle being fed during the manufacturing process is joined to the start end of a fiber bundle wound on a bobbin or stored in a package.

A known method for joining fiber bundles uses a joining fiber bundle for joining two target fiber bundles (Patent Literature 1).

CITATION LIST

Patent Literature

Patent Literature 1: Japanese Unexamined Patent Application Publication No. 2010-255168

SUMMARY OF INVENTION

Technical Problems

However, fiber bundles joined with the method described in Patent Literature 1 can often break at their joints during carbonization, and lower the throughput success ratio of passage of a carbonization process and degrade productivity.

In response to the above issue, one or more aspects of the present invention are directed to a method for manufacturing carbon fibers and a fiber joining method with a high throughput success ratio of passage of a carbonization process and with high productivity.

Solution to Problems

A method for manufacturing carbon fibers according to one aspect of the present invention includes joining a first target fiber bundle and a second target fiber bundle with a joining fiber bundle, and carbonizing the joined fiber bundles by feeding the fiber bundles through one or more carbonization furnaces. The joining includes forming an overlap between a first end of the joining fiber bundle and a second end of the first target fiber bundle and jetting a fluid to the overlap to form a first entangled portion, and forming an overlap between a second end of the joining fiber bundle and a first end of the second target fiber bundle and jetting a fluid to the overlap to form a second entangled portion. When each of the first entangled portion and the second entangled portion has two or more entangling points N1 each having a tensile force F1 not less than 400 N, the relationship defined by inequality (1) is satisfied:

$$40>\{L2/(L2-A)\}\times(S+13) \quad (1)$$

where L2 is a length in mm of an elongation section inside a first carbonization furnace most upstream in a direction in which the fiber bundles are fed, A is a maximum distance in mm between an entangling point in the first entangled portion and an entangling point in the second entangled portion, and S is an elongation in percentage of the joined fiber bundles being fed through the carbonization furnace.

A joining method according to another aspect of the present invention includes joining a first target fiber bundle and a second target fiber bundle with a joining fiber bundle. The first target fiber bundle is carbonized when being fed through one or more carbonization furnaces and yet to be carbonized. The second target fiber bundle is carbonized when being fed through the one or more carbonization furnaces and yet to be carbonized. The joining the first target fiber bundle and the second target fiber bundle includes forming an overlap between a first end of the joining fiber bundle and a second end of the first target fiber bundle and jetting a fluid to the overlap to form a first entangled portion, and forming an overlap between a second end of the joining fiber bundle and a first end of the second target fiber bundle and jetting a fluid to the overlap to form a second entangled portion. When each of the first entangled portion and the second entangled portion has two or more entangling points N1 each having a tensile force F1 not less than 400 N, the relationship defined by inequality (1) is satisfied:

$$40>\{L2/(L2-A)\}\times(S+13) \quad (1)$$

where L2 is a length in mm of an elongation section inside a first carbonization furnace most upstream in a direction in which the fiber bundles are fed, A is a maximum distance in mm between an entangling point in the first entangled portion and an entangling point in the second entangled portion, and S is an elongation in percentage of the joined fiber bundles being fed through the carbonization furnace.

Advantageous Effects of Invention

The method for manufacturing carbon fibers and the fiber joining method according to the above aspects of the present invention enable carbonization of the joined fiber bundles without breakage, and have a high throughput success ratio of passage of a carbonization process and high productivity of carbon fibers.

DESCRIPTION OF EMBODIMENTS

Figure 1:
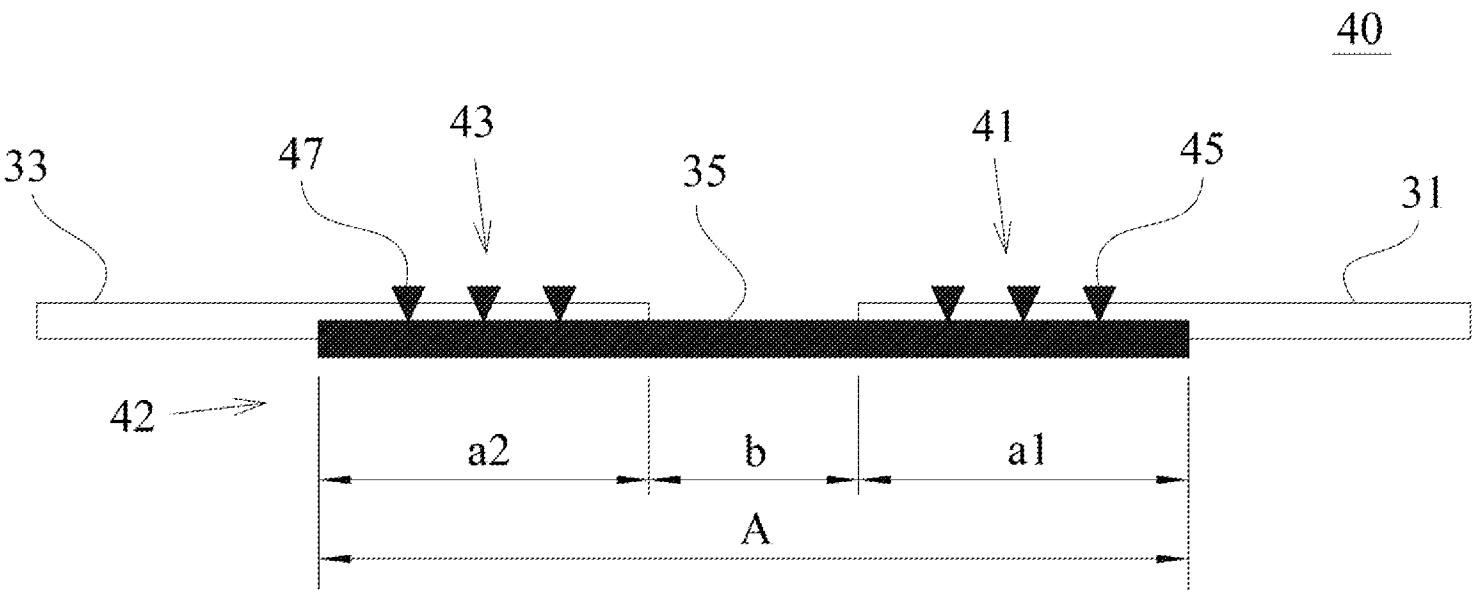
FIG. 1 is a diagram describing an example structure for joining fiber bundles according to one embodiment.

A method for manufacturing carbon fibers according to one aspect of the present invention includes joining a first target fiber bundle and a second target fiber bundle with a joining fiber bundle, and carbonizing the joined fiber bundles by feeding the fiber bundles through one or more carbonization furnaces. The joining includes forming an overlap between a first end of the joining fiber bundle and a second end of the first target fiber bundle and jetting a fluid to the overlap to form a first entangled portion, and forming an overlap between a second end of the joining fiber bundle and a first end of the second target fiber bundle and jetting a fluid to the overlap to form a second entangled portion. When each of the first entangled portion and the second entangled portion has two or more entangling points N1 each having a tensile force F1 not less than 400 N, the relationship defined by inequality (1) below is satisfied:

$$40>\{L2/(L2-A)\}\times(S+13) \quad (1)$$

where L2 is a length in mm of an elongation section inside a first carbonization furnace most upstream in a direction in which the fiber bundles are fed, A is a maximum distance in mm between an entangling point in the first entangled portion and an entangling point in the second entangled portion, and S is an elongation in percentage of the joined fiber bundles being fed through the carbonization furnace.

This method enables carbonization of the joined fiber bundles without breakage, and increases the productivity of carbon fibers.

In the method for manufacturing carbon fibers according to the above aspect, the one or more carbonization furnaces include a plurality of carbonization furnaces that are arranged in the direction in which the joined fiber bundles are fed.

In the method for manufacturing carbon fibers according to the above aspect, the first carbonization furnace upstream in the direction in which the fiber bundles are fed carbonizes target fiber bundles having a density of 1.30 to 1.45 g/cm$^3$. Thus, the fiber bundles have a fewer joints.

In the method for manufacturing carbon fibers according to the above aspect, the joining fiber bundle includes oxidized fibers or carbon fibers, and each of the first target fiber bundle and the second target fiber bundle includes acrylic fibers. This method produces high-performance carbon fibers. The oxidized fibers as the joining fiber bundle may be produced from acrylic fibers or rayon fibers. The carbon fibers as the joining fiber bundle may be produced from acrylic fibers or rayon fibers, or may be pitch-based.

A joining method according to another aspect of the invention includes joining, a first target fiber bundle and a second target fiber bundle with a joining fiber bundle. The first target fiber bundle is carbonized when being fed through one or more carbonization furnaces and yet to be carbonized. The second target fiber bundle that is carbonized when being fed through the one or more carbonization furnaces and yet to be carbonized. The joining the first target fiber bundle and the second target fiber bundle includes forming an overlap between the first end of the joining fiber bundle and the second end of the first target fiber bundle and jetting a fluid to the overlap to form a first entangled portion, and forming an overlap between the second end of the joining fiber bundle and the first end of the second target fiber bundle and jetting a fluid to the overlap to form a second entangled portion. When each of the first entangled portion and the second entangled portion has two or more entangling points N1 each having a tensile force F1 not less than 400 N, the relationship defined by inequality (1) below is satisfied:

$$40>\{L2/(L2-A)\}\times(S+13) \quad (1)$$

where L2 is a length in mm of an elongation section inside a first carbonization furnace most upstream in a direction in which the fiber bundles are fed, A is a maximum distance in mm between an entangling point in the first entangled portion and an entangling point in the second entangled portion, and S is an elongation in percentage of the joined fiber bundles being fed through the carbonization furnace.

This method enables carbonization of the joined fiber bundles without breakage, and increases the productivity of carbon fibers.

FIG. 1 is a diagram describing a first target fiber bundle 31 and a second target fiber bundle 33 being joined to each other with a joining fiber bundle 35. In FIG. 1, the left is upstream in the feeding direction of the fiber bundles, and the right is downstream in the feeding direction.

The first target fiber bundle 31 and the second target fiber bundle 33 will be described. The first target fiber bundle 31 and the second target fiber bundle 33 are joined to each other with the joining fiber bundle 35. More specifically, an overlap is formed between a first end of the joining fiber bundle 35 and a second end of the first target fiber bundle 31, and a fluid is jetted to the overlap to form a first entangled portion 41. An overlap is formed between a second end of the joining fiber bundle 35 and a first end of the second target fiber bundle 33, and a fluid is jetted to the overlap to form a second entangled portion 43. The first target fiber bundle 31, the second target fiber bundle 33, and the joining fiber bundle 35 have their first ends downstream and their second ends upstream in the direction in which these fiber bundles are fed.

The portion at which the first target fiber bundle 31 and the second target fiber bundle 33 are joined with the joining fiber bundle 35 is referred to as a joint 42 including the joining fiber bundle 35. This produces a fiber bundle (referred to as a continuous fiber bundle to distinguish it from other fiber bundles) 40 including the first target fiber bundle 31 and the second target fiber bundle 33 indirectly joined together with the joining fiber bundle 35. With this joining method, the first target fiber bundle 31 and the second target fiber bundle 33 are not joined directly, thus preventing the first target fiber bundle 31 and the second target fiber bundle 33 from overlapping each other.

Thus, when the first target fiber bundle 31 and the second target fiber bundle 33 are fibers of the same type, this method prevents the fibers of the same type from being densely located and generating heat at the joint 42. This prevents the first target fiber bundle 31 and the second target fiber bundle 33 from breaking in an oxidization furnace.

The method for joining the first target fiber bundle 31 and the joining fiber bundle 35, and joining the second target fiber bundle 33 and the joining fiber bundle 35 will be described later.

Each of the first target fiber bundle 31 and the second target fiber bundle 33 may include 3,000 to 50,000 filaments, and may specifically include 6,000 to 30,000 filaments. The joining fiber bundle 35 may include 3,000 to 200,000 filaments, and may specifically include 6,000 to 120,000 filaments. When the number of filaments herein ranges from A to B, for example, 6,000 to 120,000, the range includes the values A and B. In other words, the number of filaments is not less than A and is not greater than B.

Figure 2:
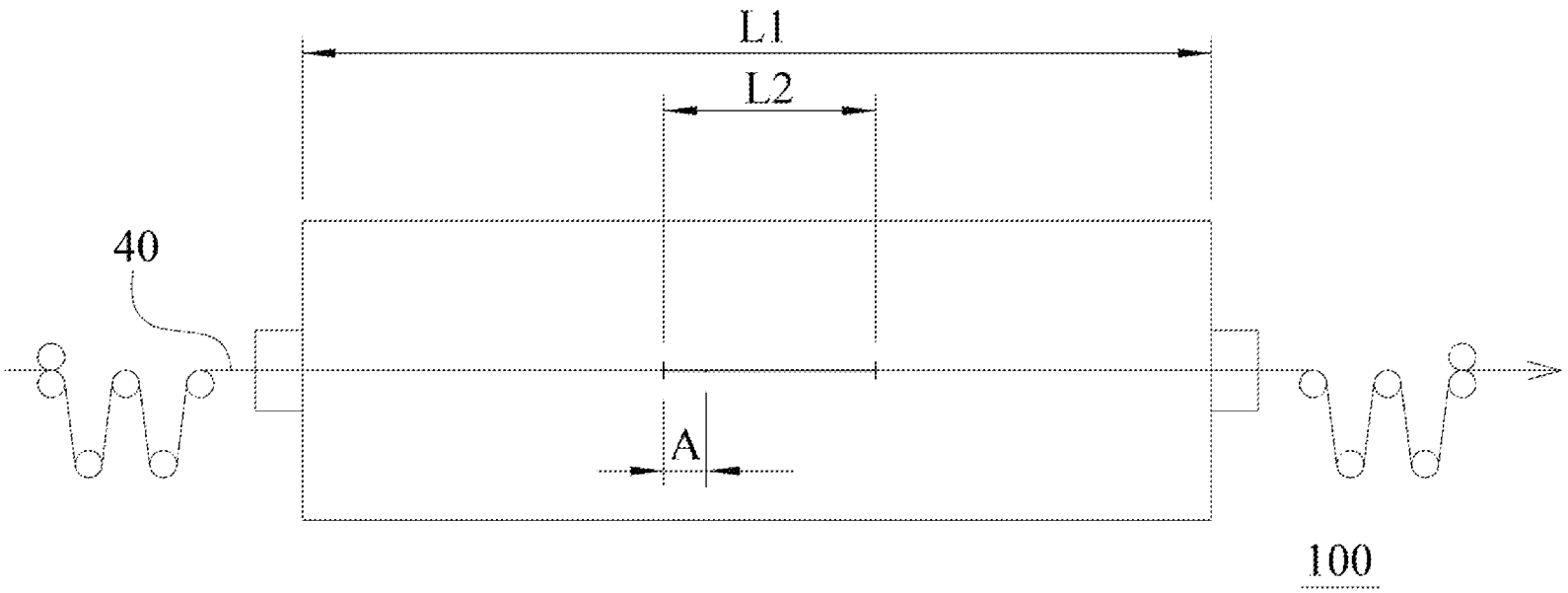
FIG. 2 is a diagram describing carbonization of joined fiber bundles in a carbonization furnace.

The joining fiber bundle 35 may include one to four times as many filaments as the first target fiber bundle 31 or the second target fiber bundle 33, and may specifically include once to twice as many filaments as the first target fiber bundle 31 or the second target fiber bundle 33. The joining fiber bundle 35 including less than once as many filaments as the first target fiber bundle 31 or the second target fiber bundle 33 causes insufficient entanglement between the fibers, thus lowering the force. The joining fiber bundle 35 including more than four times as many filaments as the first target fiber bundle 31 or the second target fiber bundle 33 causes insufficiently oxidized entangled portions, possibly causing breakage in fibers during the carbonization process. FIG. 2 is a diagram describing carbonization of a joined continuous fiber bundle in a carbonization furnace. In FIG. 2, the left is upstream in the feeding direction of the continuous fiber bundle 40, and the right is downstream in the feeding direction.

L1 is the entire length (mm) of a carbonization furnace 100. L2 is the length of an elongation section (mm) in the carbonization furnace 100.

L2 is the length of an area that undergoes active pyrolysis. In this area, the first target fiber bundle 31 and the second target fiber bundle 33 included in the fed continuous fiber bundle 40 undergo drastic changes in their composition and structure. More specifically, L2 has a start point at which processed fiber bundles 31 and 33 reach a density of 1.39 $g/cm^3$, and has an end point at which the processed fiber bundles 31 and 33 reach a density of 1.48 $g/cm^3$ inside the carbonization furnace 100. The processed fiber bundles herein are the first target fiber bundle 31 and the second target fiber bundle 33 that are to be carbonized.

When the processed fiber bundles 31 and 33 to be fed to the carbonization furnace 100 have a density greater than 1.39 $g/cm^3$, the length L2 inside the carbonization furnace 100 has a start point at which the density starts changing (increasing). When the processed fiber bundles 31 and 33 have a density not greater than 1.48 $g/cm^3$ while being carbonized through the carbonization furnace 100, the length L2 inside the carbonization furnace 100 has an end point at which the density stops changing. The length L2 can be adjusted as appropriate by changing, for example, the processing temperatures or temperature gradients in the carbonization furnace 100 or by changing the feeding speed of the continuous fiber bundle 40 passing through the carbonization furnace 100.

The length L1 may be 500 to 50,000 mm, specifically 1,000 to 40,000 mm, and more specifically 2,000 to 30,000 mm.

The length L2 may be 100 to 10,000 mm, specifically 200 to 8,000 mm, and more specifically 400 to 6,000 mm.

The continuous fiber bundle 40 in the carbonization furnace 100 has an elongation S, which is for example the ratio of the difference between the input speed V1 of the continuous fiber bundle 40 fed into the carbonization furnace 100 and the output speed V2 of the continuous fiber bundle 40 from the carbonization furnace 100 to the input speed V1 ($S=((V2-V1)/V1)\times 100$).

The elongation S may be less than 10%, and may specifically be 0 to 8%. The method according to one or more embodiments satisfies the relationship defined by equation (1) below:

$$D=\{L2/(L2-A)\}\times(5+13) \quad (1)$$

where L2 is the length in mm of an elongation section inside the carbonization furnace 100, A is a maximum distance in mm between an entangling point in the first entangled portion 41 and an entangling point in the second entangled portion 43, S is an elongation in percentage of the continuous fiber bundle 40 fed through the carbonization furnace 100, and D is a success ratio of passage coefficient of the carbonization furnace, which is less than 40.

With the relationship defined by equation (1) being satisfied, the continuous fiber bundle 40 is less likely to break at the joint 42 during carbonization, thus increasing the success ratio of passage of the carbonization process.

To satisfy the relationship defined by equation (1), the first entangled portion 41 and the second entangled portion 43 each have two or more entangling points N1, where each entangling point has a tensile force F1 not less than 400 N. This prevents the first target fiber bundle 31 or the second target fiber bundle 33 from disjoining (breaking) under a tension applied to the continuous fiber bundle 40 fed through the oxidization furnace or the carbonization furnace 100.

The number of entangling points N1 may be three or more, and specifically four or more.

The tensile force F1 may be not greater than 1,300 N, and may specifically be 550 to 950 N.

Each entangled portion (the first entangled portion 41 and the second entangled portion 43) may not have the same number of entangling points N1, and may have different numbers of entangling points N1.

Each entangling point may not have the same tensile strength F1, and may have a different tensile force F1 that is not less than 400 N.

As shown in FIG. 1, the length A is a maximum distance between an entangling point in the first entangled portion 41 and an entangling point in the second entangled portion 43. In FIG. 1, the length A is a distance between an entangling point 45 located most downstream in the first entangled portion 41 and an entangling point 47 located most upstream in the second entangled portion 43.

The triangles shown in FIG. 1 indicate the positions at which a pressurized fluid is jetted by an entangler described later. The entangling points are the points at which fibers included in a joining fiber bundle and target fiber bundles are entangled around the positions at which a pressurized fluid is jetted.

The length A is substantially the total of a length a1 of the first entangled portion 41, a length b of an unentangled portion, and a length a2 of the second entangled portion 43. This length may be referred to as the total length of the entangled portion (or a joint length). The length b of the unentangled portion may typically be around 400 mm.

The length A may be 50 to 3,000 mm, and may specifically be 500 to 1,500 mm. The length A that is too small can cause insufficient entanglement. The length A that is too large can lower the success ratio of passage of the carbonization furnace 100.

The success ratio of passage coefficient D of the carbonization furnace is less than 40, and may be not greater than 36, may specifically be not greater than 33, and more specifically be not greater than 30. When the success ratio of passage coefficient D of the carbonization furnace is not less than 40, the success ratio of passage of the carbonization process is low, thus degrading the productivity.

A method for joining the first target fiber bundle and the second target fiber bundle according to the present embodiment will now be described with reference to the drawings.

Figure 3A:
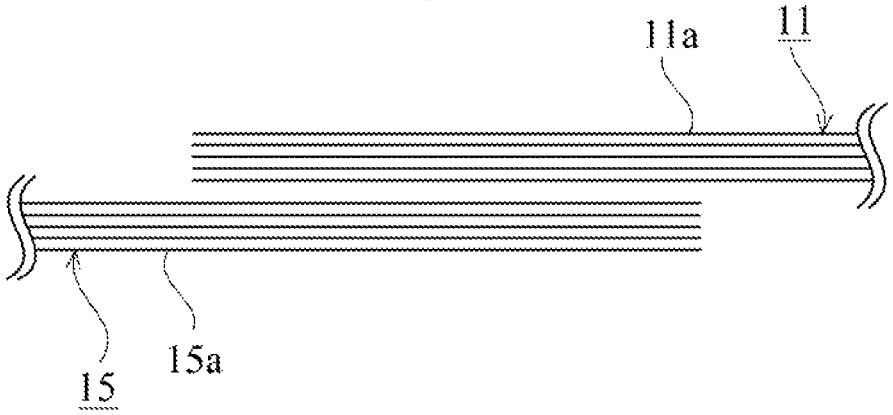
FIGS. 3A to 3C are conceptual diagrams describing the entanglement of fiber bundles joined with a joining method according to the present embodiment.
Figure 3B:
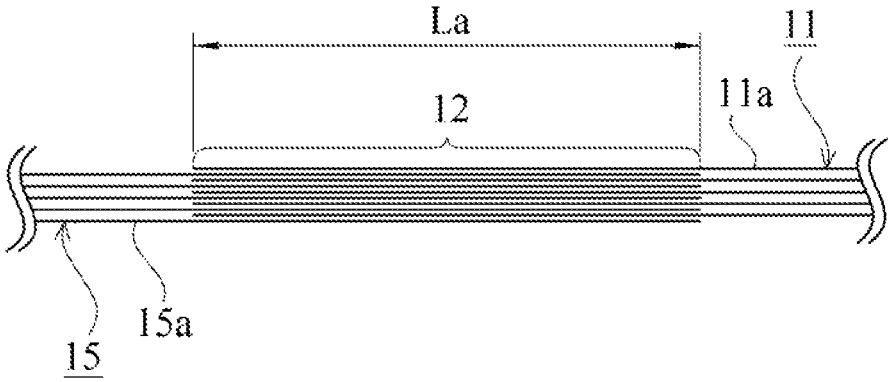
Figure 3C:
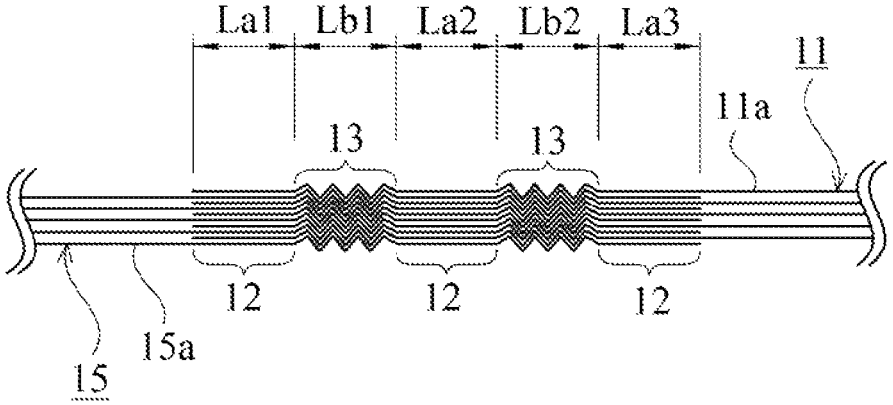

FIGS. 3A to 3C are conceptual diagrams describing the entanglement at one of the joint ends formed using a joining method according to the present embodiment.

The entanglement between the joining fiber bundle and either the first target fiber bundle or the second target fiber bundle will be described by simply referring to the first or second target fiber bundle as the target fiber bundle.

FIGS. 3A to 3C show the target fiber bundle 11, the filaments 11*a* in the target fiber bundle 11, the joining fiber bundle 15, and the filaments 15*a* in the joining fiber bundle 15.

The target fiber bundle 11 and the joining fiber bundle 15 are first pulled and aligned together to form an overlap (refer to FIG. 3A). The overlap between the target fiber bundle 11 and the joining fiber bundle 15 is then clamped at its two ends (hereafter, the points at which the target fiber bundle 11 and the joining fiber bundle 15 are clamped by clamps 21 and 23 in FIGS. 4A and 4B may be referred to as clamping points). The target fiber bundle 11 and the joining fiber bundle 15 may each have a relaxation ratio of 0.03 to 2% at the overlap when clamped. Subsequently, a fluid is jetted to the overlap between the target fiber bundle 11 and the joining fiber bundle 15 between the clamping points to open the fibers in both the target fiber bundle 11 and the joining fiber bundle 15 at the overlap between the clamping points. After receiving the jetted fluid, the target fiber bundle 11 and the joining fiber bundle 15 have their filaments remaining open without completely returning to their original positions. This forms a pre-entangled portion (preliminary entangled portion) 12 having a length La, in which individual filaments 11*a* and 15*a* commingle with one another on a single filament unit (refer to FIG. 3B).

The relaxation ratio is defined by the equation below.

Relaxation ratio (%)=(the actual length of fiber bundle clamped between the clamping points—the direct distance between the clamping points)/the direct distance between the clamping points×100

The fiber bundle in the above equation includes the target fiber bundle 11 and the joining fiber bundle 15.

The pre-entangled portion 12 is then unclamped, and then receives a jet of a fluid. The jetted fluid turns and tightly twists the pre-entangled target fiber bundle 11 and the joining fiber bundle 15 into main-entangled portions (fully entangled portion) 13 with lengths Lb1 and Lb2 (refer to FIG. 3C). The main-entangled portions 13 may have a length shrinkage of 1 to 40%. In FIG. 3C, the pre-entangled portion 12 receives the jetted fluid at two spots to have two main-entangled portions 13 in total. One main-entangled portion 13 and sections in the pre-entangled portion 12 adjacent to the main-entangled portion 13 form one entangling point.

The length shrinkage percentage is defined by the equation below.

Length shrinkage (%)=[the length of the pre-entangled portion 12 before main-entanglement—(the total length of the main-entangled portions 13 formed in the pre-entangled portion 12+the total length of the remaining pre-entangled portion 12)]/the total length of the main-entangled portions 13×100

In FIG. 3C, the length shrinkage equates to [La−(Lb1+Lb2+La1+La2+La3)]/(Lb1+Lb2)×100.

Figure 4A:
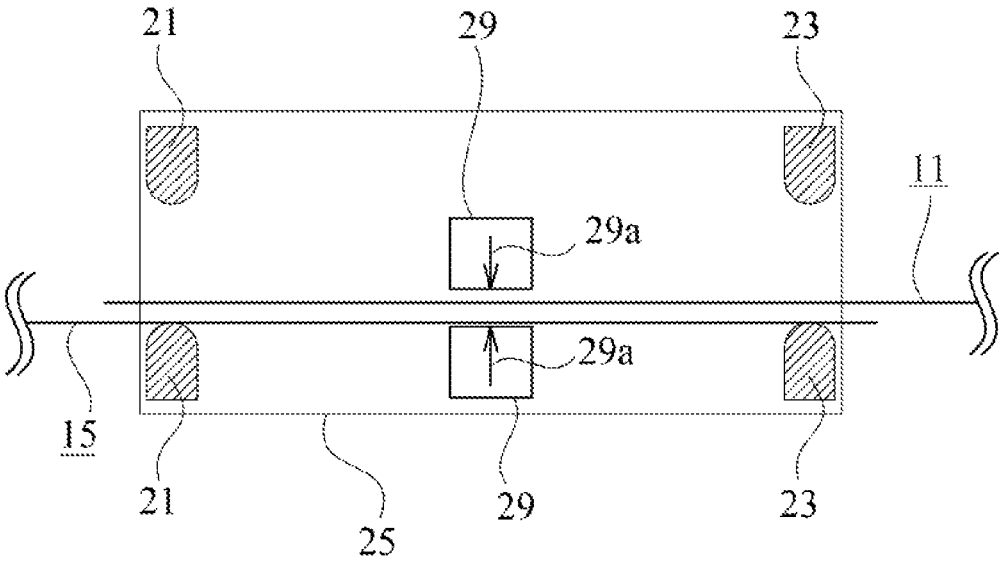
FIGS. 4A and 4B are diagrams describing the structure of an example apparatus implementing the joining method according to the present embodiment.
Figure 4B:
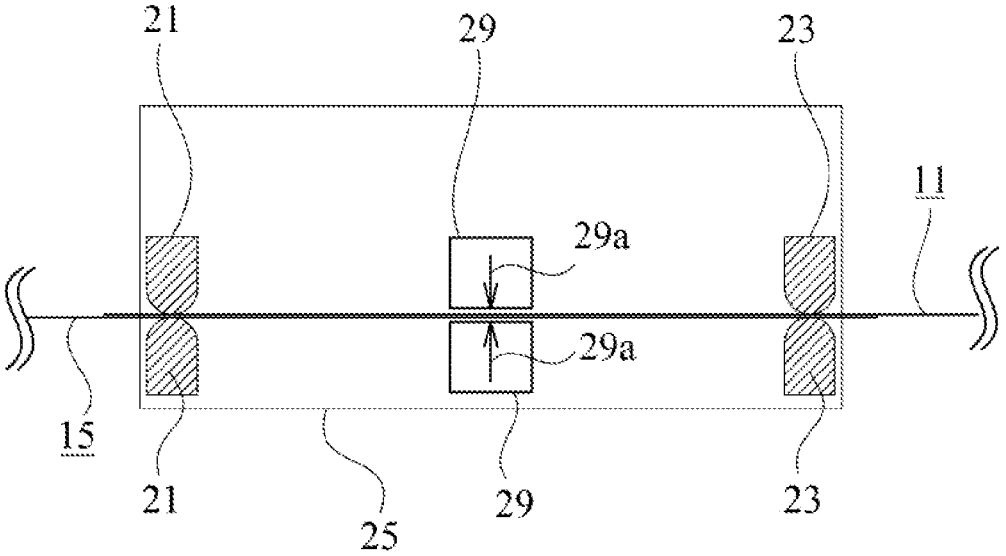

FIGS. 4A and 4B are diagrams describing the structure of an example apparatus implementing the joining method according to the present embodiment. FIG. 4A shows the target fiber bundle 11 and the joining fiber bundle 15 in an entangling apparatus 25. The entangling apparatus 25 includes an entangler 29, which is reciprocable in a fiber bundle direction (the longitudinal direction of the fiber bundles), and the clamps 21 and 23 for clamping the target fiber bundle 11 and the joining fiber bundle 15. The target fiber bundle 11 and the joining fiber bundle 15 may be joined together using a single entangling apparatus 25 or a plurality of entangling apparatuses 25 that are arranged in a row in the fiber bundle direction. The entangler 29 is connected to a fluid feeder (not shown). Arrows 29*a* indicate the direction in which the fluid flows. FIG. 4B shows the target fiber bundle 11 and the joining fiber bundle 15 clamped by the clamps 21 and 23.

The target fiber bundle 11 and the joining fiber bundle 15 are placed through the entangling apparatus 25 to have their corresponding ends overlapping each other by a predetermined length (refer to FIG. 4A). The target fiber bundle 11 and the joining fiber bundle 15 are then clamped by the clamps 21 and 23 to form an overlap between the clamps 21 and 23 (refer to FIG. 4B). The target fiber bundle 11 and the joining fiber bundle 15 that are clamped together may each have a relaxation ratio of 0.03 to 2% between the clamping points.

The relaxation ratio may be adjusted by directly measuring the actual length of each of the target fiber bundle 11 and the joining fiber bundle 15, and clamping the target fiber bundle 11 and the joining fiber bundle 15 with a predetermined actual length, or by clamping the target fiber bundle 11 and the joining fiber bundle 15 without relaxing, and then shifting the clamping points in the fiber bundle direction.

Subsequently, the entangler 29, which is reciprocable in the fiber bundle direction, jets a high-pressure fluid to the target fiber bundle 11 and joining fiber bundle 15 that are clamped together. This commingles the individual filaments 11*a* and 15*a* in the target fiber bundle 11 and the joining fiber bundle 15 to form the pre-entangled portion 12 (refer to FIG. 3B).

The clamps 21 and 23 then unclamp the target fiber bundle 11 and the joining fiber bundle 15. This frees the target fiber bundle 11 and the joining fiber bundle 15 in the pre-entangled portion 12. The freed pre-entangled portion 12 then receives a jet of a high-pressure fluid from the entangler 29. This forms the main-entangled portions 13 in the pre-entangled portion 12 (refer to FIG. 3C), thus joining the target fiber bundle 11 and the joining fiber bundle 15.

In FIGS. 4A and 4B, the entangling apparatus 25 includes a single entangler 29. The entangling apparatus 25 may include a plurality of entanglers 29. The entangler 29 may include any known component such as an interlacing nozzle.

The pre-entanglement according to the present embodiment refers to placing the target fiber bundle and the joining fiber bundle with an overlap and clamping the bundles into a fixed state, and jetting a high-pressure fluid to the overlap to commingle individual filaments in the fiber bundles with one another. The filaments in the target fiber bundle and the joining fiber bundle are commingled in the fixed state substantially without turning. The fiber bundles are thus substantially not twisted.

The pre-entanglement may be performed using a plurality of fixed entanglers or one or more movable entanglers that reciprocate in the fiber bundle direction. The entanglers may or may not jet a fluid while moving. More specifically, the entanglers may jet a fluid while moving, or may stop and jet a fluid.

The target fiber bundle and the joining fiber bundle in the fixed state may have their two ends clamped with a relaxation ratio of 0.03 to 2%, and specifically with a relaxation ratio of 0.1 to 1%. At the relaxation ratio less than 0.03%, the fiber bundles may not easily form the pre-entangled portion. The fiber bundles are also easily damaged by the high-pressure fluid. At the relaxation ratio greater than 2%, the fiber bundles may easily twist and may not easily form the pre-entangled portion. When the individual filaments in the target fiber bundle and the joining fiber bundle fail to commingle with each other in the pre-entangled portion, the resultant continuous fiber bundle can contain the target fiber bundle unevenly distributed at the joint. Heat can accumulate in the unevenly distributed portion of the continuous fiber bundle (joint) to cause breaks.

The pre-entangled portion may form entirely across or in part of the overlap between the target fiber bundle and the joining fiber bundle.

The pre-entangled portion may have a length of 90 to 2,000 mm (a total length, or a length La in FIG. 3B), and specifically 140 to 1,000 mm. When the pre-entangled portion has a length less than 90 mm, the target fiber bundle and the joining fiber bundle commingled together may have insufficient strength. When the pre-entangled portion has a length greater than 2,000 mm, larger devices and apparatuses are to be used for the entanglement. This is economically disadvantageous.

The main-entanglement according to the present embodiment may refer to freeing the pre-entangled portion and jetting a high-pressure fluid to the pre-entangled portion for turning the target fiber bundle and the joining fiber bundle for entanglement. The target fiber bundle and the joining fiber bundle undergo this main-entanglement in the freed state. The fiber bundles in the pre-entangled portion receiving a jet of high-pressure fluid turn to form twists in the pre-entangled portion.

The main-entanglement may be performed using a plurality of fixed entanglers, or one or more movable entanglers that first reciprocate in the fiber bundle direction, and then stop to complete the main-entanglement. The pre-entanglement and the main-entanglement may be performed with the same entangler or with different entanglers dedicated to each entanglement process.

Each main-entangled portion may have a length not less than 15 mm, and specifically not less than 20 mm. The length of the main-entangled portion may be less than the length of a section of the pre-entangled portion. The main-entangled portion may have sections of the pre-entangled portion on its two ends. Each section of the pre-entangled portion may have a length not less than 10 mm. When the length of the main-entangled portion is either less than 15 mm or is greater than the length of one section of the pre-entangled portion, the joint may have insufficient strength.

The degree of entanglement in the main-entanglement portion is expressed by the length shrinkage described above. The length shrinkage may be 1 to 40%, and may specifically be 3 to 33%. When the length shrinkage is less than 1%, the twist in the fiber bundles may be insufficient and have insufficient joint strength. When the length shrinkage is greater than 40%, the joint may become too tight and have an excessively high density in the target fiber bundle. This may cause breakage at the joint due to heat accumulation.

The joining method according to the present embodiment may be used for joining two target fiber bundles with a single joining fiber bundle.

The method for joining two target fiber bundles with a joining fiber bundle according to the present embodiment is used in the process of manufacturing carbon fibers. Typically, carbon fibers are manufactured by heating bundles of acrylic fibers, which are an example of a fiber material, to 150 to 300° C. in the air to obtain oxidized fibers, and then heating the oxidized fibers to 1,000° C. or higher in an inert atmosphere in a carbonization furnace. When the joining method according to the present embodiment is used for manufacturing carbon fibers, the first target fiber bundle 31 and the second target fiber bundle 33 are acrylic fibers or oxidized fibers obtained by oxidizing acrylic fibers. The first target fiber bundle 31 and the second target fiber bundle 33 may have a density of 1.30 to 1.45 g/cm$^3$, and specifically 1.35 to 1.43 g/cm$^3$ before being fed through the carbonization furnace. The first target fiber bundle 31 and the second target fiber bundle 33 may have the same density or different densities.

The joining fiber bundle 35 includes carbon fibers or oxidized fibers obtained by oxidizing acrylic fibers. The oxidized fibers may have a density of 1.30 to 1.45 g/cm$^3$, and specifically 1.35 to 1.43 g/cm$^3$. When the density is less than 1.30 g/cm$^3$, the target fiber bundle or the joining fiber bundle included in the joint easily accumulates heat during the oxidization process and breaks. When the density is greater than 1.45 g/cm$^3$, the fiber bundle is disadvantageous mainly economically. Although acrylic fibers generate heat during oxidization through a chemical reaction, carbon fibers and oxidized fibers generate almost no heat during oxidization. Joining two target fiber bundles including acrylic fibers using a joining fiber bundle including oxidized fibers prevents acrylic fibers from being densely located at the joint between the target fiber bundles and the joining fiber bundle. This method thus prevents such heat-generating fibers (acrylic fibers) from being densely located and accumulating heat at the joint.

Examples of the high-pressure fluid jetted by the entangler 29 include compressed air, compressed gases such as an inert gas, and fluids such as water. As described above, the entangler in use may be fixed or may reciprocate in the fiber bundle direction. In some embodiments, a fixed entangler and a movable entangler may be used in combination.

The fluid jetted to the target fiber bundle and the joining fiber bundle may have a pressure of 0.2 to 0.8 MPa, and specifically 0.3 to 0.7 MPa. At the pressure less than 0.2 MPa, the fibers may undergo insufficient commingling and insufficient main-entanglement. At the pressure greater than 0.8 MPa, the portions of the target fiber bundle and the joining fiber bundle except the entangled portion are easily disturbed and damaged.

A movable entangler may jet a high-pressure fluid to the target fiber bundle and the joining fiber bundle for 3 to 90 seconds, and specifically for 5 to 60 seconds. A fixed entangler may jet a high-pressure fluid to the fiber bundles for 1 to 30 seconds, and specifically for 2 to 20 seconds. A short jetting time may cause insufficient entanglement, whereas a long jetting time can be disadvantageous mainly economically.

A movable entangler may move at 1 to 200 mm/s, and specifically at 5 to 60 mm/s. A movable entangler that moves at speeds slower than 1 mm/s can be disadvantageous mainly economically. A movable entangler that moves at speeds faster than 200 mm/s can cause insufficient pre-entanglement or insufficient main-entanglement.

A movable entangler may travel a distance of 90 to 2,000 mm, and specifically 140 to 1,000 mm. As described above, a pre-entangled portion having a length less than 90 mm may have insufficient strength by commingling the target fiber bundle and the joining fiber bundle. A pre-entangled portion having a length greater than 2,000 mm may increase difficulties in handling the target fiber bundle and the joining fiber bundle, or may upsize the apparatuses, and is thus economically disadvantageous.

A single movable entangler may be used, or a plurality of movable entanglers may be used at intervals of 50 to 1,000 mm.

A movable entangler may reciprocate 1 to 10 times, and specifically 2 to 5 times, to form the pre-entangled portion. The entangler reciprocating less than once may cause insufficient commingling. The entangler reciprocating more than 10 times may cause fuzzy fibers in the target fiber bundle and the joining fiber bundle. The resultant fuzzy fibers in the fiber bundles can cause troubles in the main-entanglement or subsequent manufacturing processes.

A movable entangler may reciprocate 0.5 to 3 times, and specifically 1 to 2 times, to form the main-entangled portion. The entangler reciprocating less than 0.5 times may cause insufficient main-entanglement. The entangler reciprocating more than 3 times may cause fuzzy fibers in the target fiber bundle and the joining fiber bundle. The resultant fuzzy fibers in the fiber bundles can cause troubles in subsequent manufacturing processes. The main-entangled portion may be formed while the entangler is moving within the length of the pre-entangled portion. Although any number of main-entangled portions may be formed, a fewer main-entangled portions are economically advantageous.

When a fixed entangler is used, two to ten main-entangled portions may be formed per joint, and specifically three to eight main-entangled portions may be formed per joint. A joint including less than two main-entangled portions may have insufficient joint strength. A joint including more than ten main-entangled portions may be disadvantageous mainly economically.

The distance between the main-entangled points (or the distance between the center points of adjacent main-entangled portions) may be 50 to 1,000 mm. At the distance less than 50 mm, adjacent main-entangled portions may interact with each other to degrade their states of main-entanglement. At the distance greater than 1,000 mm, the main-entangled portions are disadvantageous mainly economically.

EXAMPLES

One or more embodiments of the present invention will now be described using examples and comparative examples. However, the present invention should not be limited to the examples below and may be modified variously unless they depart from the scope and spirit of the invention.

Example 1

A continuous fiber bundle (refer to FIG. 1) was produced by joining two target fiber bundles (a first target fiber bundle and a second target fiber bundle) with a joining fiber bundle. The target fiber bundles are acrylic fiber bundles including 24,000 filaments, and the joining fiber bundle is a carbon fiber bundle including 24,000 filaments.

The joining fiber bundle and the first target fiber bundle were placed to have their corresponding ends overlapping each other, and a fluid was jetted to the overlap to form a first entangled portion. More specifically, the first target fiber bundle and the joining fiber bundle were pulled and aligned together with each other to form an overlap using an apparatus with the structure shown in FIG. 4. The first target fiber bundle and the joining fiber bundle were then clamped to form the overlap with a relaxation ratio of 0.3%.

The overlap then received a jet of compressed air (with a pressure of 0.5 MPa) applied from two movable nozzles that are spaced from each other by 200 mm for 30 seconds, with the nozzles reciprocating twice along the overlap while jetting the air. The first target fiber bundle and the joining fiber bundle are commingled into a pre-entangled portion with a length of 400 mm.

Subsequently, the first target fiber bundle and the joining fiber bundle were unclamped. The pre-entangled portion then received a jet of compressed air (with a pressure of 0.5 MPa) applied from two movable nozzles for 5 seconds to form five main-entangled portions (first entangled portions) with a length shrinkage of 20% (five entangling points).

Subsequently, the joining fiber bundle and the second target fiber bundle were placed to have their corresponding ends overlapping each other, and a fluid was jetted to the overlap to form a second entangled portion. The second entangled portion was formed in the same manner as the first entangled portion.

In this manner, the first target fiber bundle and the second target fiber bundle were indirectly joined to each other using the joining fiber bundle into the continuous fiber bundle.

Process Success Ratio of Passage

The continuous fiber bundle produced in example 1 was oxidized and carbonized. Table 1 below shows the results. In the working examples and the comparative examples, the process success ratio of passage refers to the ratio of continuous fiber bundles that have successfully passed through the oxidization process and the carbonization process without having breaks at their joints.

Carbonization

The continuous fiber bundle was carbonized under the conditions shown in Table 1 below including the elongation section length L2 in a carbonization furnace, the total length L1 of the carbonization furnace, and the elongation S of the continuous fiber bundle.

Examples 2 to 11 and Comparative Examples 1 to 5

Using the target fiber bundles and the joining fiber bundles each including the number of filaments shown in Table 1, continuous fiber bundles having tensile force F1 at the entangling points, which are the entangling points N1, and the total lengths A of the entangling points shown in Table 1 were produced in the same manner as the continuous fiber bundle produced in example 1. Subsequently, the continuous fiber bundles were carbonized under the conditions shown in Table 1 below including the elongation section length L2 in a carbonization furnace, the total length L1 of the carbonization furnace, and the elongation S of the continuous fiber bundles.

TABLE 1

| | Number of Filaments | | | | | | | | | Process Success Ratio of Passage (%) | |
|---|---|---|---|---|---|---|---|---|---|---|---|
| | Target Fiber | Joining Fiber | F1 (N) | N1 | A (mm) | L2 (mm) | L1 (mm) | S (%) | D | Oxidization | Carbonization |
| Example 1 | 24,000 | 24,000 | 950 | 5 | 750 | 3,750 | 15,000 | 8 | 26.3 | 100 | 100 |
| Example 2 | 24,000 | 24,000 | 550 | 5 | 750 | 3,750 | 15,000 | 8 | 26.3 | 100 | 100 |
| Example 3 | 24,000 | 24,000 | 950 | 5 | 1,500 | 3,750 | 15,000 | 8 | 35.0 | 100 | 100 |
| Example 4 | 24,000 | 24,000 | 950 | 5 | 300 | 3,750 | 15,000 | 15 | 30.4 | 100 | 100 |
| Example 5 | 12,000 | 12,000 | 950 | 5 | 750 | 3,750 | 15,000 | 8 | 26.3 | 100 | 100 |
| Example 6 | 12,000 | 24,000 | 950 | 5 | 750 | 3,750 | 15,000 | 8 | 26.3 | 100 | 100 |
| Example 7 | 24,000 | 48,000 | 950 | 5 | 750 | 3,750 | 15,000 | 8 | 26.3 | 100 | 100 |
| Example 8 | 48,000 | 48,000 | 950 | 5 | 750 | 3,750 | 15,000 | 8 | 26.3 | 100 | 100 |
| Example 9 | 24,000 | 24,000 | 950 | 2 | 300 | 3,750 | 15,000 | 8 | 22.8 | 100 | 100 |
| Example 10 | 24,000 | 24,000 | 950 | 7 | 750 | 3,750 | 15,000 | 8 | 26.3 | 100 | 100 |
| Example 11 | 24,000 | 24,000 | 950 | 5 | 750 | 1,875 | 7,500 | 8 | 35.0 | 100 | 100 |
| Comparative Example 1 | 24,000 | 24,000 | 350 | 5 | 750 | 3,750 | 15,000 | 8 | 26.3 | 70 | 40 |
| Comparative Example 2 | 24,000 | 24,000 | 950 | 5 | 2,000 | 3,750 | 15,000 | 8 | 45.0 | 100 | 20 |
| Comparative Example 3 | 24,000 | 24,000 | 950 | 5 | 750 | 3,750 | 15,000 | 20 | 41.3 | 100 | 30 |
| Comparative Example 4 | 24,000 | 48,000 | 950 | 5 | 2,000 | 3,750 | 15,000 | 8 | 45.0 | 100 | 20 |
| Comparative Example 5 | 12,000 | 12,000 | 950 | 5 | 2,000 | 3,750 | 15,000 | 8 | 45.0 | 100 | 20 |

Evaluation

As shown in Table 1, the fiber bundles according to examples 1 to 11 all had a 100% success ratio of passage of the oxidization process and the carbonization process.

In contrast, the fiber bundle according to comparative example 1 with entangling points having a tensile force F1 of less than 400 N showed a significantly lower success ratio of passage of the oxidization process and the carbonization process.

The fiber bundles according to comparative examples 2 to 5 each with the throughput success ratio of passage coefficient D of the carbonization furnace of 40 or greater showed a significantly lower throughput success ratio of passage of the carbonization process.

Modifications

Although the present invention has been described based on the embodiments above, the invention is not limited to the embodiments. For example, modifications described below may each be combined with any of the embodiments, and some of the modifications may be combined with one another as appropriate.

1. Pre-Entangled Portion and Main-Entangled Portion

Although a pre-entangled portion is formed before main-entangled portions are formed in the above embodiments, main-entangled portions may be formed without forming a pre-entangled portion. In this case, entangling points also serve as main-entangled portions.

2. Pressure of Fluid Jetted to Fiber Bundles

The pressure of the fluid jetted to the fiber bundles may not be the same at a plurality of entangling points, and may differ at each entangling point.

3. Carbonization Furnace

Although one carbonization furnace is used in the embodiments, a plurality of carbonization furnaces may be used. The carbonization furnace may be vertical or horizontal. When a plurality of carbonization furnaces are used, a carbonization furnace most upstream in the feeding direction of fiber bundles is referred to as a first carbonization furnace. The first carbonization furnace may be used to carbonize target fiber bundles having a density of 1.30 to 1.45 g/cm$^3$.

REFERENCE SIGNS LIST

11 target fiber bundle
12 pre-entangled portion
13 main-entangled portion
15 joining fiber bundle
31 first target fiber bundle
33 second target fiber bundle
35 joining fiber bundle
40 continuous fiber bundle

The invention claimed is:

1. A method for manufacturing carbon fibers, comprising:

joining a first target fiber bundle and a second target fiber bundle with a joining fiber bundle to obtain joined fiber bundles; and carbonizing the joined fiber bundles by feeding the fiber bundles through one or more carbonization furnaces, wherein the joining includes forming an overlap between a first end of the joining fiber bundle and a second end of the first target fiber bundle and jetting a fluid to the overlap in a state where both ends of the overlap are clamped at a relaxation ratio of 0.03 to 2% to form a first entangled portion, and forming an overlap between a second end of the joining fiber bundle and a first end of the second target fiber bundle and jetting a fluid to the overlap in a state where both ends of the overlap are clamped at a relaxation ratio of 0.03 to 2% to form a second entangled portion, and the entangled portions are formed such that each of the first entangled portion and the second entangled portion has two or more entangling points N1 each having a tensile force F1 not less than 400 N, so as to satisfy the relationship defined by inequality (1):

$$40>\{L2/(L2-A)\}\times(S+13) \quad (1)$$

wherein L2 is a length in mm of an elongation section inside a first carbonization furnace most upstream in a direction in which the fiber bundles are fed, A is a maximum distance in mm between an entangling point in the first entangled portion and an entangling point in the second entangled portion, and S is an elongation in percentage of the joined fiber bundles being fed through the carbonization furnace.

2. The method according to claim 1, wherein the one or more carbonization furnaces comprise a plurality of carbonization furnaces that are arranged in the direction in which the joined fiber bundles are fed.

3. The method according to claim 1, wherein the first carbonization furnace most upstream in the direction in which the fiber bundles are fed is configured to carbonize target fiber bundles having a density of 1.30 to 1.45 g/cm$^3$.

4. The method according to claim 2, wherein the first carbonization furnace most upstream in the direction in which the fiber bundles are fed is configured to carbonize target fiber bundles having a density of 1.30 to 1.45 g/cm$^3$.

5. The method according to claim 1, wherein the joining fiber bundle comprises oxidized fibers or carbon fibers, and each of the first target fiber bundle and the second target fiber bundle comprises acrylic fibers.

6. A joining method, comprising:

joining a first target fiber bundle and a second target fiber bundle with a joining fiber bundle to obtain joined fiber bundles, the first target fiber bundle being configured to be carbonized when being fed through one or more carbonization furnaces and yet to be carbonized, the second target fiber bundle being configured to be carbonized when being fed through the one or more carbonization furnaces and yet to be carbonized, the joining the first target fiber bundle and the second target fiber bundle including forming an overlap between a first end of the joining fiber bundle and a second end of the first target fiber bundle and jetting a fluid to the overlap in a state where both ends of the overlap are clamped at a relaxation ratio of 0.03 to 2% to form a first entangled portion, and forming an overlap between a second end of the joining fiber bundle and a first end of the second target fiber bundle and jetting a fluid to the overlap in a state where both ends of the overlap are clamped at a relaxation ratio of 0.03 to 2% to form a second entangled portion, the entangled portions are formed such that each of the first entangled portion and the second entangled portion has two or more entangling points N1 each having a tensile force F1 not less than 400 N, so as to satisfy the relationship defined by inequality (1):

$$40>\{L2/(L2-A)\}\times(S+13) \quad (1)$$

wherein L2 is a length in mm of an elongation section inside a first carbonization furnace most upstream in a direction in which the fiber bundles are fed, A is a maximum distance in mm between an entangling point in the first entangled portion and an entangling point in the second entangled portion, and S is an elongation in percentage of the joined fiber bundles being fed through the carbonization furnace.

* * * * *